United States Patent [19]

Steiner

[11] 4,423,961

[45] Jan. 3, 1984

[54] FEED MIXING APPARATUS

[75] Inventor: Roy I. Steiner, Orrville, Ohio

[73] Assignee: Sevenson Company, Orrville, Ohio

[21] Appl. No.: 384,535

[22] Filed: Jun. 3, 1982

[51] Int. Cl.[3] ..... B01F 9/06

[52] U.S. Cl. ..... 366/183; 366/188; 366/228; 366/229

[58] Field of Search ..... 366/41, 53, 54, 57, 366/58, 59, 62, 63, 135, 150, 183, 187, 188, 192, 193, 219, 220, 221, 224, 225, 227, 228, 229, 603

[56] References Cited

U.S. PATENT DOCUMENTS

| | | | |
|---|---|---|---|
| 56,520 | 7/1866 | Brigham | 366/302 |
| 695,801 | 3/1902 | Dillon | 366/307 |
| 941,767 | 11/1909 | Dickson | 366/192 |
| 1,048,763 | 12/1912 | Tiedtke | 366/135 |
| 2,080,508 | 5/1937 | Sackett | 366/192 |
| 2,367,585 | 1/1945 | Huszar | 366/187 X |
| 2,592,481 | 4/1952 | Spencer et al. | 366/307 |
| 2,668,693 | 2/1954 | Gard | 366/192 |
| 3,259,372 | 7/1966 | Phillips | 366/135 |
| 3,338,559 | 8/1967 | Fisher | 366/135 |
| 3,346,240 | 10/1967 | Lavelle et al. | 366/307 |
| 3,552,721 | 1/1971 | Phillips | 366/135 |
| 3,829,066 | 8/1974 | Phillips | 366/135 |
| 4,075,713 | 2/1978 | Easton | 366/192 |

*Primary Examiner*—Robert W. Jenkins
*Assistant Examiner*—Arthur D. Dahlberg
*Attorney, Agent, or Firm*—Mack D. Cook, II

[57] ABSTRACT

A feed mixing apparatus for use wherever livestock is cared for and fed. The apparatus has a portable base and a shaft mounted rotatable cylindrical drum with internal mixing and conveying blades. A frame grate on the base is positioned in front of a cylindrical drum opening for drum shaft mounting, feed constituent supply and mixed feed discharge.

7 Claims, 12 Drawing Figures

FIG. 8
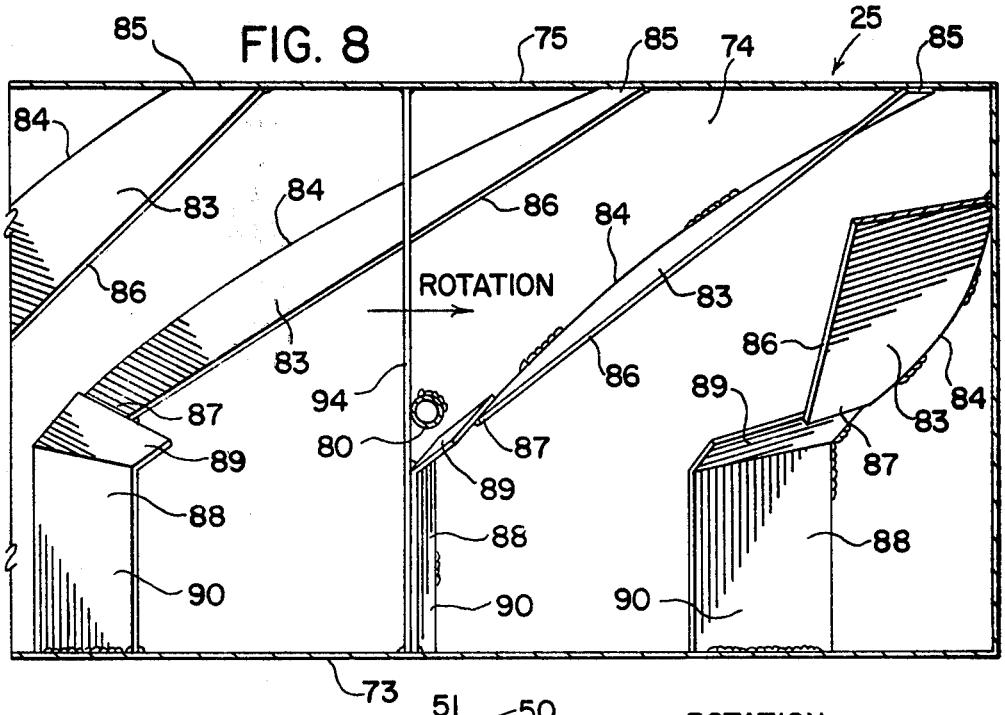
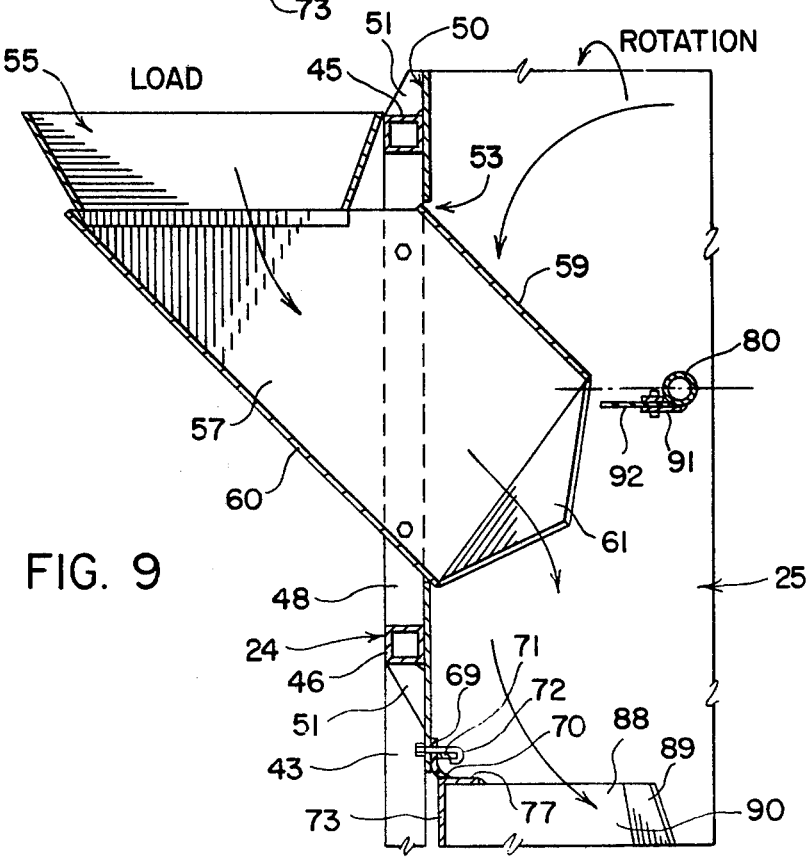
FIG. 9

FEED MIXING APPARATUS

BACKGROUND OF THE INVENTION

The invention relates to a feed mixing apparatus for use wherever livestock is cared for and fed. A farmer or rancher has an obligation every day of the year to mix and deliver feed for animal consumption. There are also many other daily chores to which to attend. The "feed time" chore must be handled in the shortest possible time at the lowest possible cost, using inexpensive and easily maintained equipment and wasting little of the feed constituents or the mixed feed.

The scope and content of the prior art has been determined. (See, form PTO-1449 in the file wrapper.) The most relevant prior art is: AH, U.S. Pat. No. 3,839,066, 8/1974, Phillips; AI, U.S. Pat. No. 4,075,713, 2/1978, Easton.

Phillips discloses a "particulate material mixing machine" which could be used for mixing feed for animal consumption.

In the first embodiment (FIGS. 1-6) of Phillips, the machine 10 has a frame 14, a generally horizontal shaft 21 mounted on the frame, a drum 11 having a tubular wall 12 and a rear wall 13 mounted on the shaft and means (95, 96, 102) for rotating the drum 11. The reduced diameter front end 12*a* of the drum is received with a stationary hood 15 having an outer wall 16 and an end wall 17. An auger assembly 40 attached to the hood wall 17 has discharge port 79 opening into the drum interior. A fan 77 on the auger shaft 74 functions "for flinging particulate material . . . into the drum more than half the axial distance between said end wall (17) and rear wall (13)." Col. 16, 11. 54-57. The hood 15 and drum 11 have cooperating means, including scoop members 54, for elevating material from a vertically lower position as the drum 11 is rotated and selectively discharging the material through a delivery chute 81 or into the auger assembly. The interior of the drum 11 has internal mixing blades 90, troughs 91 and plates 92.

The inventor has no first-hand knowledge as to the operating capabilities and functional characteristics of a Phillips mixer. However, it is apparent that a Phillips mixer would be costly to build and difficult to maintain by a farmer or rancher.

Easton more nearly approximates the requirements of a rancher or farmer "for a feed mixer that is highly simplified in structure [and] that is efficient in its operation." The Easton mixer comprises a stationary hemicylinder drum 11 housing a rotary agitator 16 and an improved closure means in the bottom of the drum.

SUMMARY OF THE INVENTION

The object of the invention is to provide a portable, efficient, inexpensive to acquire and to operate, and easy to maintain feed mixing apparatus; an apparatus comprising a combination of elements for use wherever livestock is cared for and fed, by farmer or rancher.

The present invention was conceived because the farm and ranch segments of the agricultural economy were not being supplied with the right combination of equipment for feed mixing. Storage silos and grain bins present no problem. Supply and delivery equipment is readily available. What has not been available is a feed mixing apparatus possessing the inherent advantages of the present invention—portability, efficiency, cost and maintenance.

These and other ojects of the invention, as well as the operating advantages thereof, wll be apparent in view of the following drawings and specification.

According to the invention, a mixing apparatus for livestock feed constituents has a portable base and a rotatable cylindrical drum with internal mixing and conveying blades. The drum is mounted on a shaft positioned above the base and projecting coaxially through a cylindrical opening in the front wall of a drum. The base carries a pedestal structure extending upwardly adjacent the rear wall of a drum for mounting the rear end of the drum shaft.

The mixer base also carries a frame grate extending upwardly adjacent the front wall of the drum and having a vertically extending medial plate for mounting the front end of the projecting drum shaft.

The front frame grate also has two openings formed therein, one on either side of the medial plate. One opening is for supply of feed constituents. The other opening is for discharge of mixed feed.

The front frame grate also provides a suspension mounting for a circular drum service plate. The service plate will hang free around the perimeter or outer edge, is positioned coaxially around the drum shaft and is oriented parallel with and adjacent to the cylindrical drum opening.

The drum service plate has two openings formed therein. One opening is a supply opening in alignment with the frame grate supply opening. The other opening is a discharge opening in alignment with the frame grate discharge opening.

The front frame grate also carries a hopper chute extending downwardly through the aligned supply openings and the drum opening and a selectively closable scoop chute extending upwardly through the aligned discharge openings and the drum opening.

THE DRAWINGS

FIG. 8 is a fragmentary section, taken substantially as indicated on line 8—8 of FIG. 6;

FIG. 9 is a fragmentary section, taken substantially as indicated on line 9—9 of FIG. 2;

DETAILED DESCRIPTION OF THE INVENTION

Figure 1:
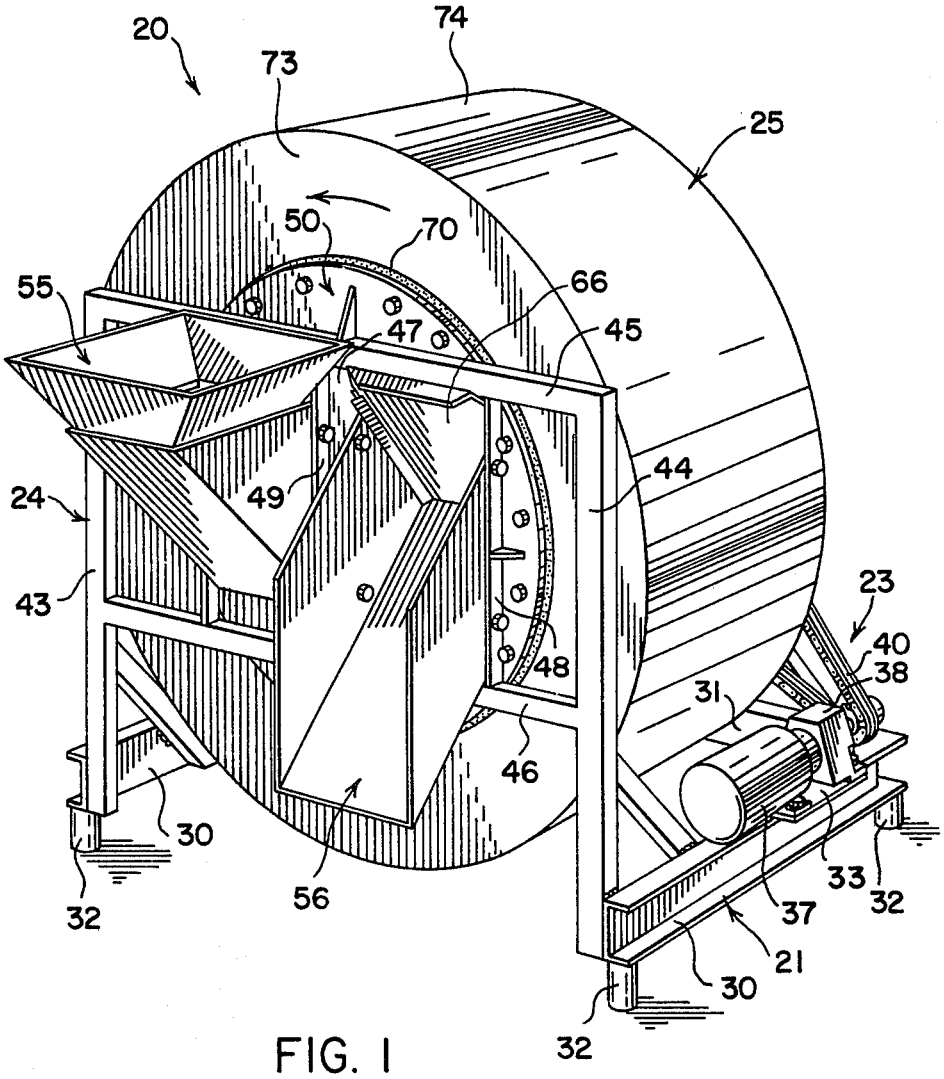
FIG. 1 is an isometric view of a feed mixing apparatus according to the invention.
Figure 2:
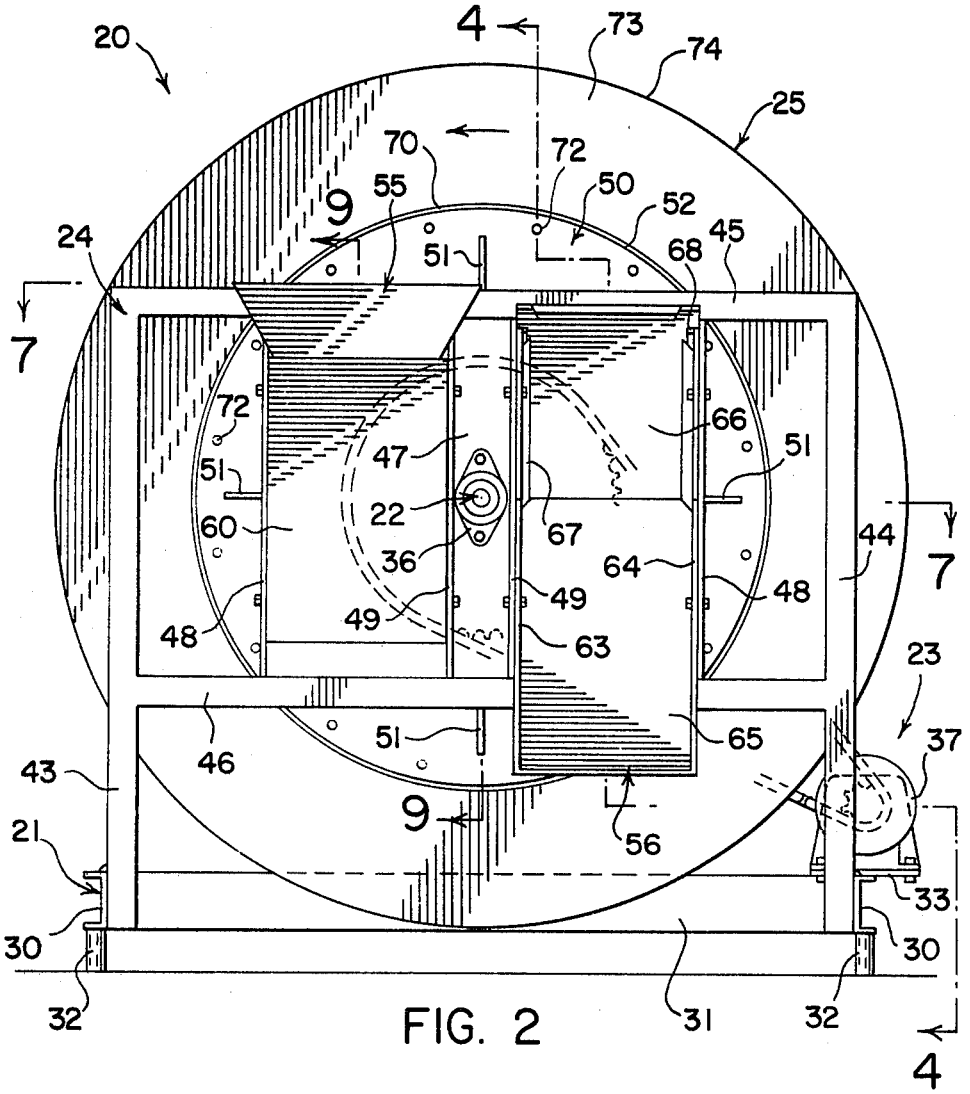
FIG. 2 is a front elevation of the feed mixer.

A feed mixing apparatus according to the invention is referred to generally by the numeral 20. The function and purpose of an apparatus 20 is to mix and discharge various feed constituents for animal consumption. The feed constituents are selectively delivered to the apparatus 20 by the user or by a supply conveyor (not shown). After mixing by the apparatus 20, the mixed feed is taken away by the user or by a delivery conveyor (not shown).

A feed mixer 20 has five primary or basic components. A portable base 21. A drum mounting shaft 22 positioned parallel to the base 21. A drum drive mechanism 23 mounted on the base 21. A front frame grate 24 for drum shaft mounting, feed constituent supply and mixed feed discharge carried by the base 21. A rotatable mixing drum 25, with internal mixing and conveying blades.

The base 21

The floor or ground mounted portable base 21 is fabricated as a weldment. As shown, the horizontally oriented components of a base 21 include parallel left side and right side channels 30 and a rear cross channel 31. The side channels 30 have leg pads 32. The right side channel 30 has a platform 33 for mounting the motor component of the drum drive mechanism 23. The rear cross channel 31 carries a pedestal structure 34 extending upwardly adjacent the rear wall of the drum 25 for mounting the rear end of the drum shaft 22.

The shaft 22

The steel shaft 22 provides the axis for rotation of the drum 25 by the drive mechanism 23. As shown, the shaft is non-rotatably positioned parallel to and above the base 21 by a rear pillow block 35 and a front pillow block 36. The rear block 35 is mounted on the pedestal structure 34. The front block 36 is mounted on a medial plate on the frame grate 24.

The drum drive mechanism 23

The drum drive mechanism 23 provides for uni-directional rotation of the drum 25 around the shaft 22 (in a counter clockwise direction when viewed from the front of the mixer 20). As shown, an electric motor 37 mounted on the base platform 33 is coupled to a speed reducer unit 38 having an output shaft carrying a smaller diameter sprocket 39. The drive sprocket 39 actuates a loop of drive chain 40 trained around a larger diameter drum sprocket 41. The drum sprocket 41 is positioned around the non-rotatable drum shaft 22 and is secured to the rear wall of the drum 25 by a series of fastening bolts 42.

The front frame grate 24

The front frame grate 24 is carried by the base 21 to extend upwardly adjacent the front wall of the drum 25 being rotated around shaft 22 by the drive 23. The frame grate 24 may be fabricated as a weldment.

As shown, the frame grate 24 has a lattice structure formed from four interconnected sections of square tubing. Left side and right side vertical sections, 43 and 44, have lower ends adapted to be secured to the front end of a base side channel 30. The upper ends of sections 43 and 44 are cross-connected by an upper lateral section 45. The medial portions of sections 43 and 44 are cross-connected by a lower lateral section 46. The inner parameters of interconnected sections 43–46 define an area or open space oriented parallel with and adjacent to the front wall of a drum 24. This area is allocated to or divided into segments for three functions essential in use of the mixing apparatus 20. A medial segment for drum shaft mounting. A side segment for feed constituent supply. An opposite side segment for mixed feed discharge.

A medial segment within the parameters of frame grate sections 43–46 is covered by a vertically extending web 47 (of service plate 50 described below). The medial plate 47 receives the projecting end of the drum shaft 22 and carries the front shaft pillow block 36.

On either side of the medial plate 47, the left and right segments are spanned by left side and right side vertical flange bars, 48 and 49, secured to the upper and lower lateral sections, 45 and 46. The parameters of connected lateral sections 45 and 46 and vertical bars 48 and 49 functionally define two openings in the frame grate 24. A left side supply opening for feed constituents. A right side discharge opening for mixed feed.

The frame grate 24 has a circular service plate 50 for the mixing drum 25. As shown, four small equally spaced gussets 51 will provide a suspension mounting for the service plate 50 against the inner face of the frame grate 24. The service plate 50 will hang free around its perimeter or radial edge 52. The service plate 50 is positioned coaxially around the drum shaft 22. The service plate 50 is oriented parallel with and adjacent to a cylindrical opening in the front wall of the mixing drum 25.

The drum service plate 50 has two openings formed therein. A supply opening 53 in lateral alignment with the left side supply opening between a set of frame grate vertical bars, 48 and 49. A discharge opening 54 in lateral alignment with the right side discharge opening between the opposite set of frame grate vertical bars, 48 and 49.

The vertical extent of the service plate openings, 53 and 54, is determined by the vertical dimensions of two chute structures positioned therein and secured to the frame grate vertical bars, 48 and 49. A hopper chute 55 extends downwardly through the aligned supply openings into the interior of the mixing drum 25. A closable scoop chute 56 extends upwardly through the aligned discharge openings into the interior of the drum 25.

A hopper chute 55 has left and right radially outer and inner vertical side walls, 57 and 58, removably fastened to a set of frame grate bars, 48 and 49. An upper baffle plate 59 is secured to and covers the side walls, 57 and 58. The baffle plate 59 extends downwardly from the upper edge of the service plate opening 53. A slide plate 60 is secured to the lower edges of the side walls, 57 and 58. The slide plate 60 extends downwardly to the lower edge of the service plate opening 53. A triangular deflector plate 61 is carried on the downward end of the left or outer side wall 57. The deflector plate 61 is directed toward the center of the mixing drum 25.

A scoop chute 56 has left and right vertical side walls, 63 and 64, removably fastened to a set of frame grate bars, 48 and 49. The upper edges of the side walls, 63 and 64, extend to the upper edge of the service plate opening 54. A slide plate 65 is secured to the lower edges of the side walls, 63 and 64. The slide plate 65 extends upwardly beyond the lower edge of the service plate opening 54. A selectively removable closure plate 66 extends downwardly beneath the upper edge of the service plate opening 54 and over the upward ends of the side walls, 63 and 64, and slide plate 65 to close the scoop chute 56.

Figure 5:
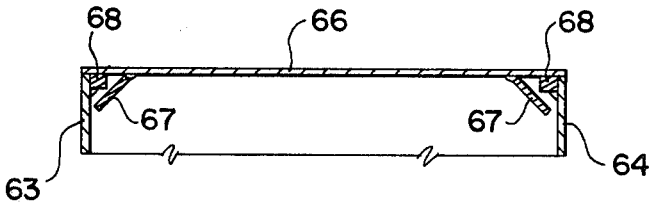
FIG. 5 is a detail section, taken substantially as indicated on line 5—5 of FIG. 4.
Figure 3:
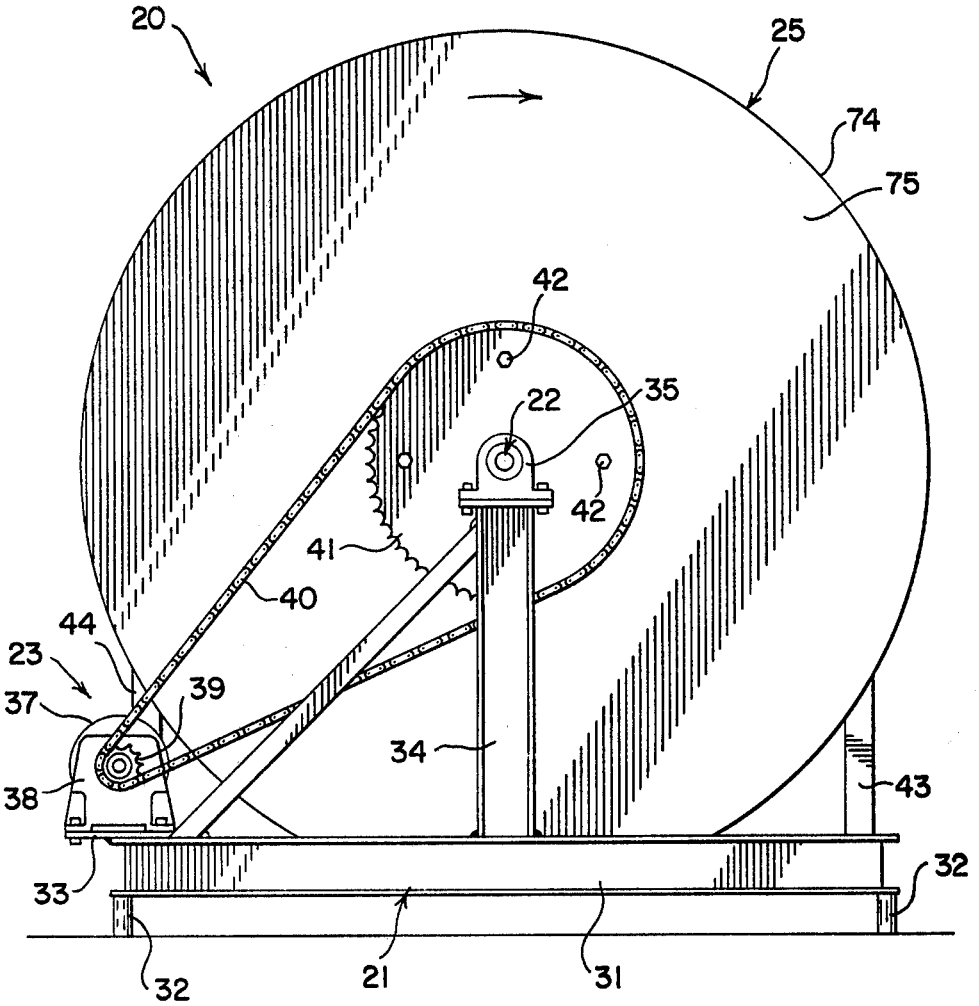
FIG. 3 is a rear elevation of the feed mixer.
Figure 4:
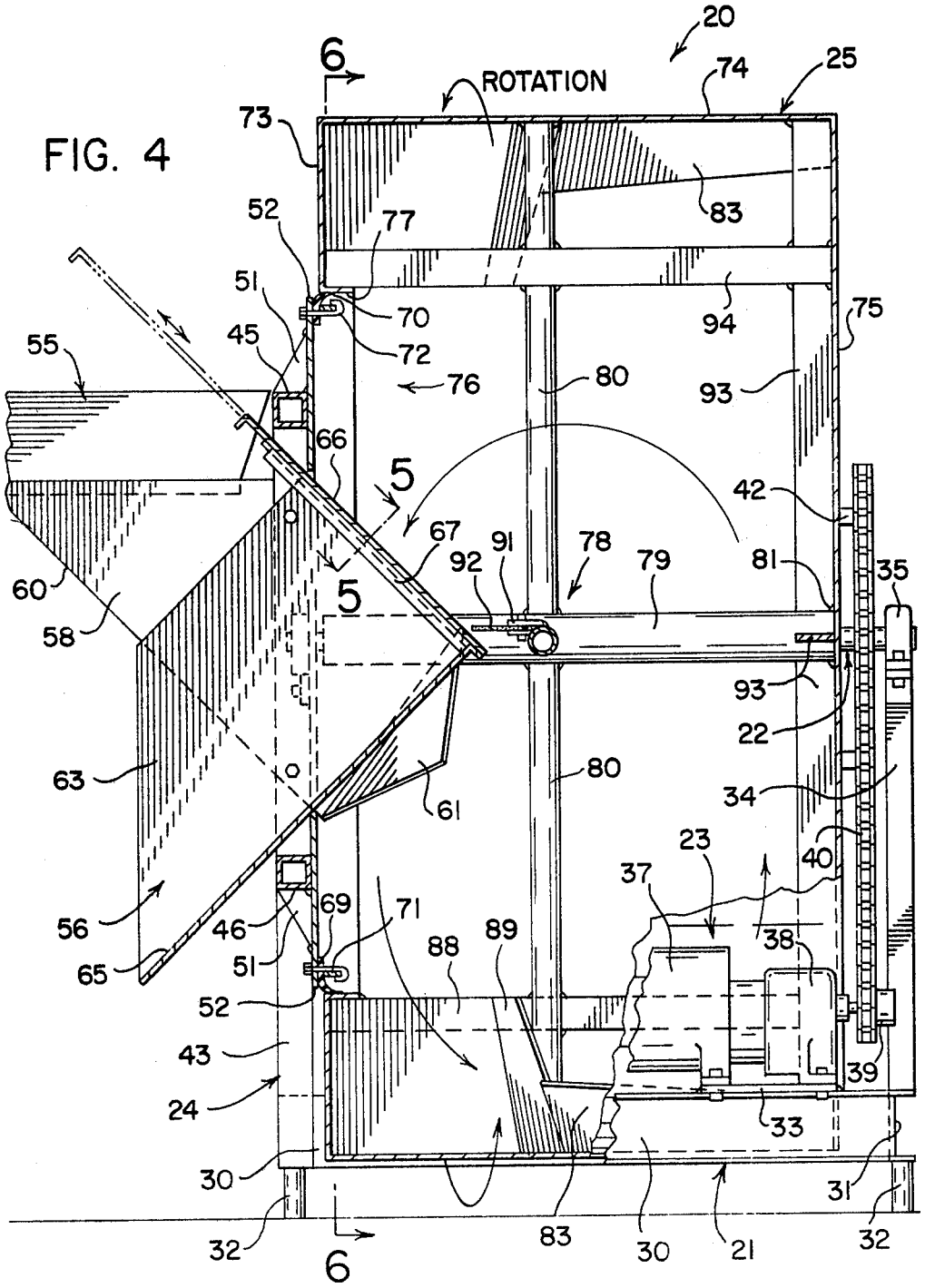
FIG. 4 is a side elevation in section, taken substantially as indicated on line 4—4 of FIG. 2.
Figure 6:
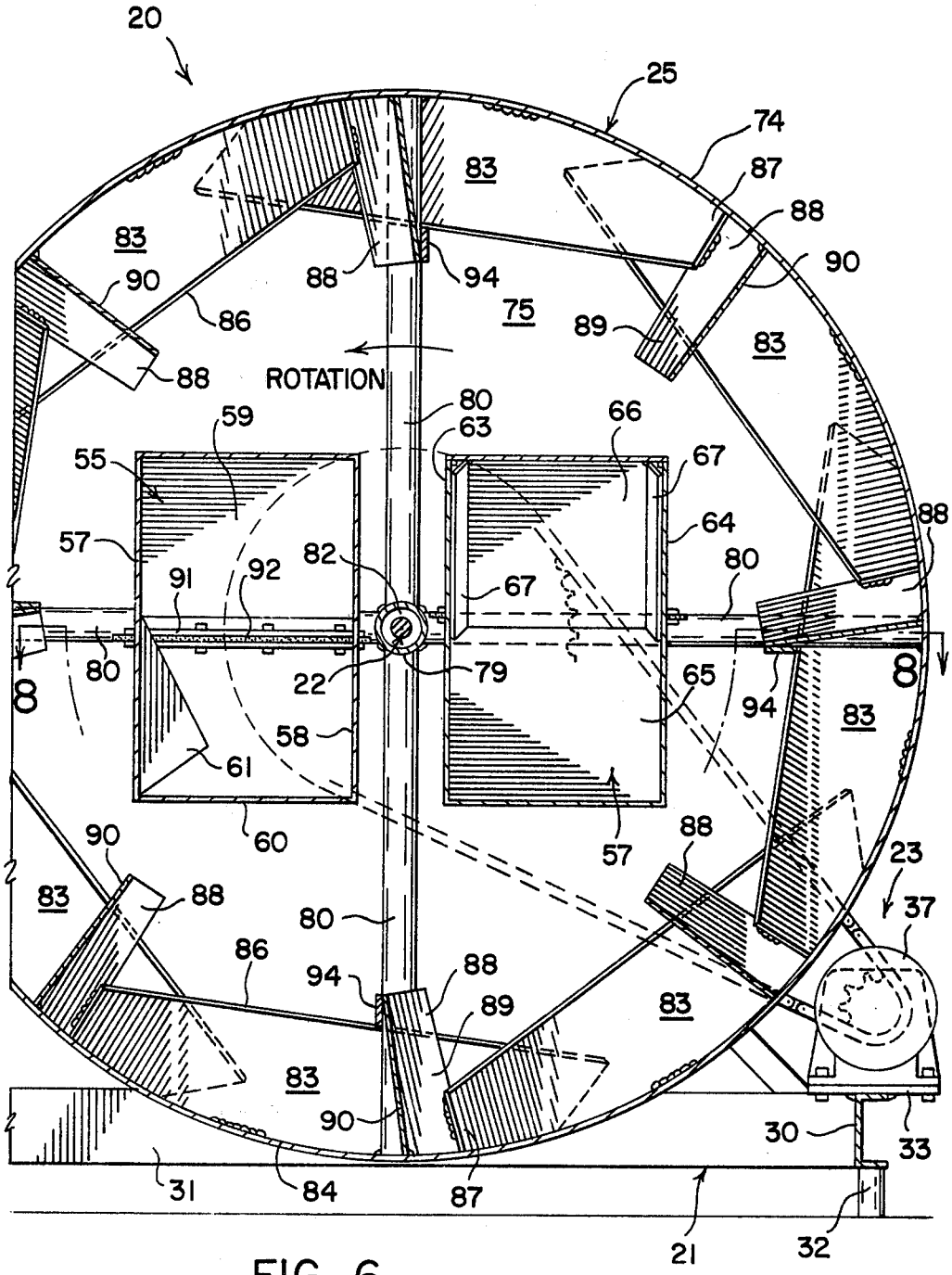
FIG. 6 is a front elevation in section, taken substantially as indicated on line 6—6 of FIG. 4.
Figure 7:
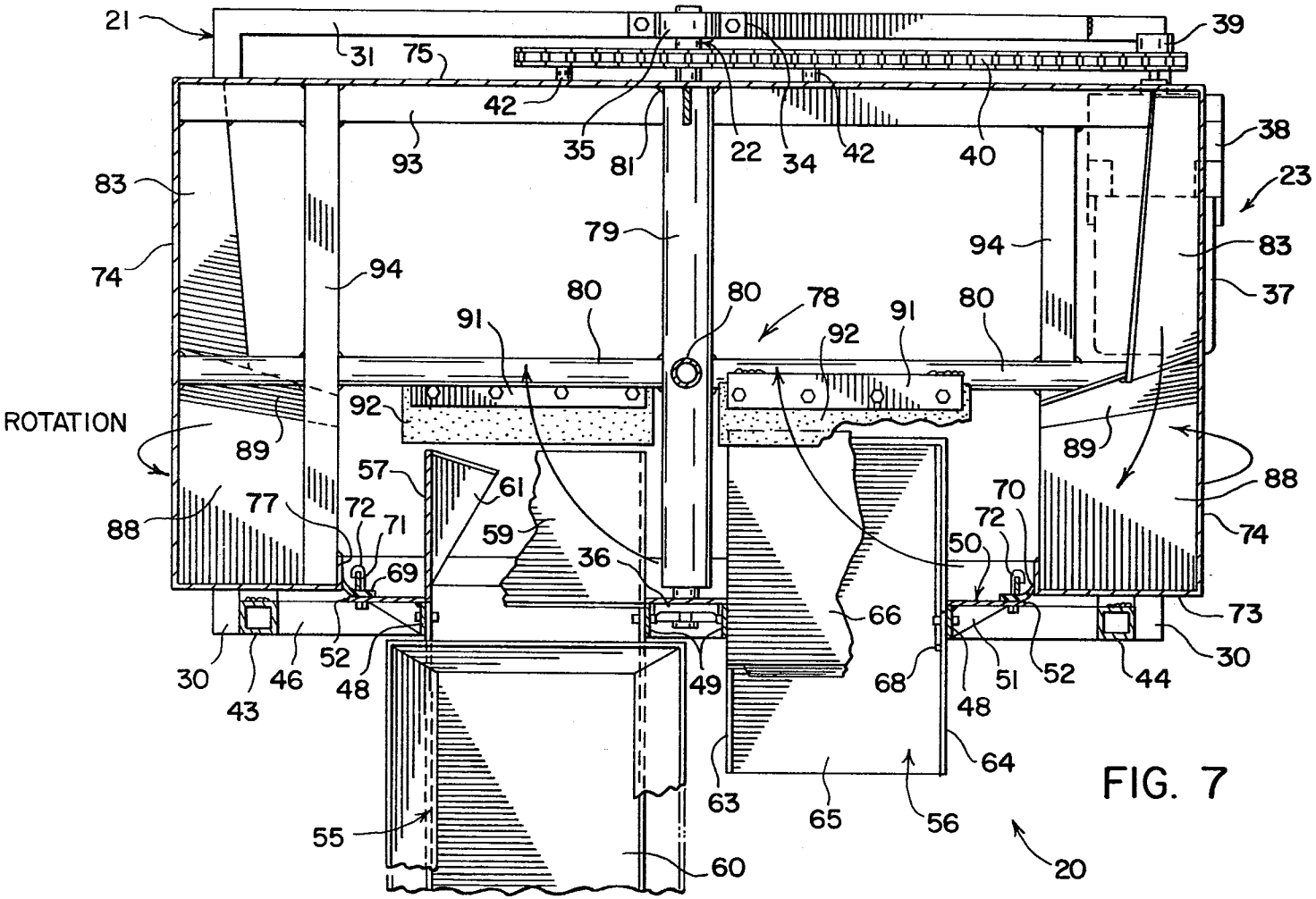
FIG. 7 is a top elevation in section, taken substantially as indicated on line 7—7 of FIG. 2.
Figure 10:
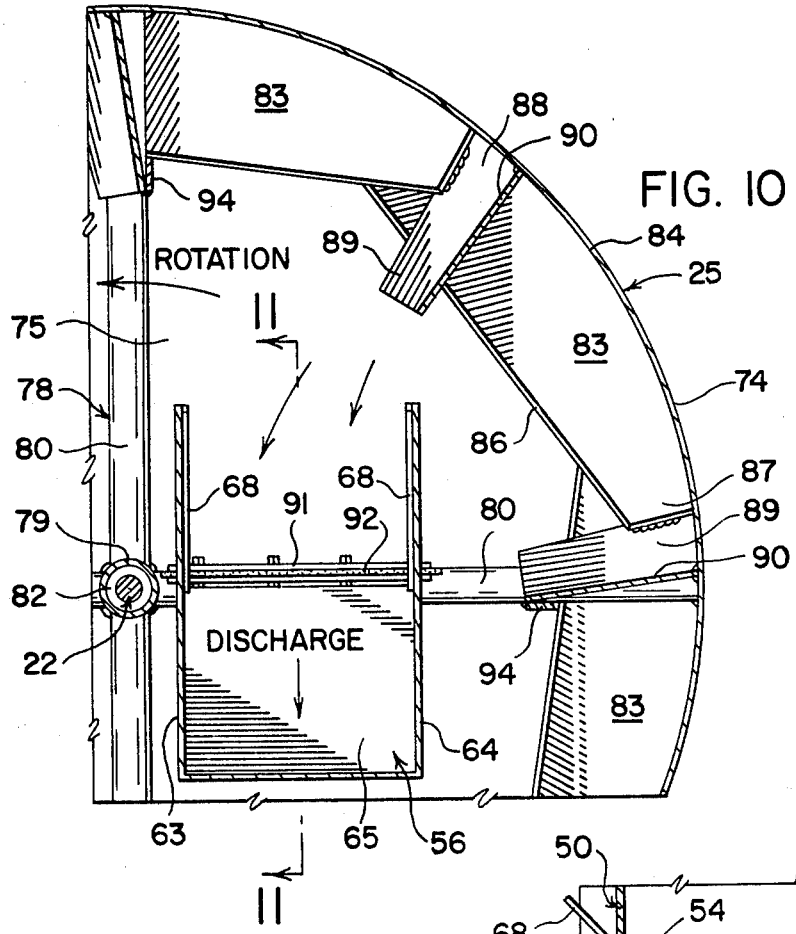
FIG. 10 is a fragmentary section showing the upper right side of the feed mixer, during discharge of mixed feed.
Figure 11:
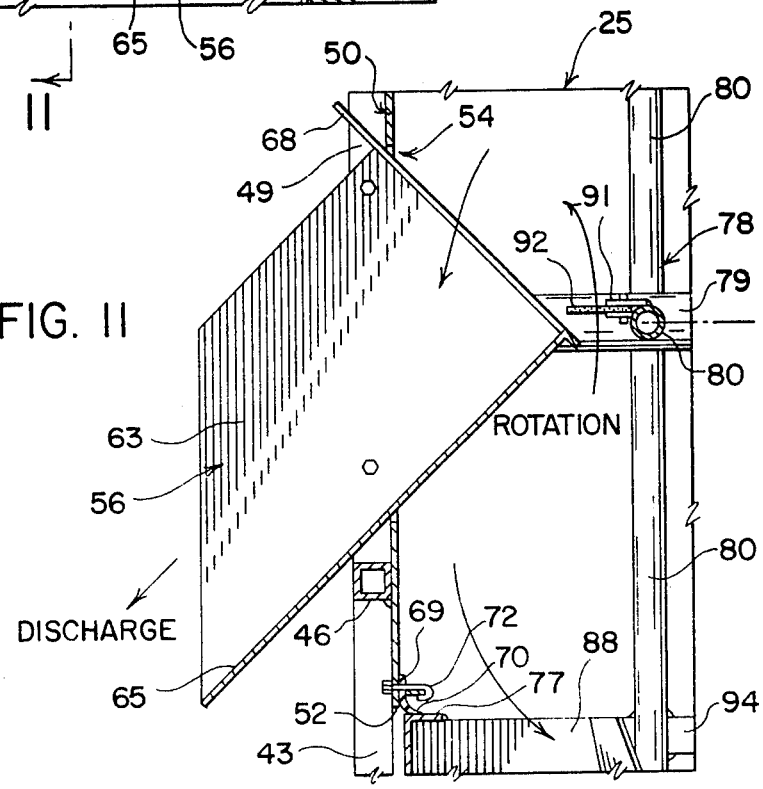
FIG. 11 is a fragmentary section, taken substantially as indicated on line 11—11 of FIG. 10; and, FIG. 12 is an exploded isometric view, showing the components of a feed mixing apparatus according to the invention.
Figure 12:
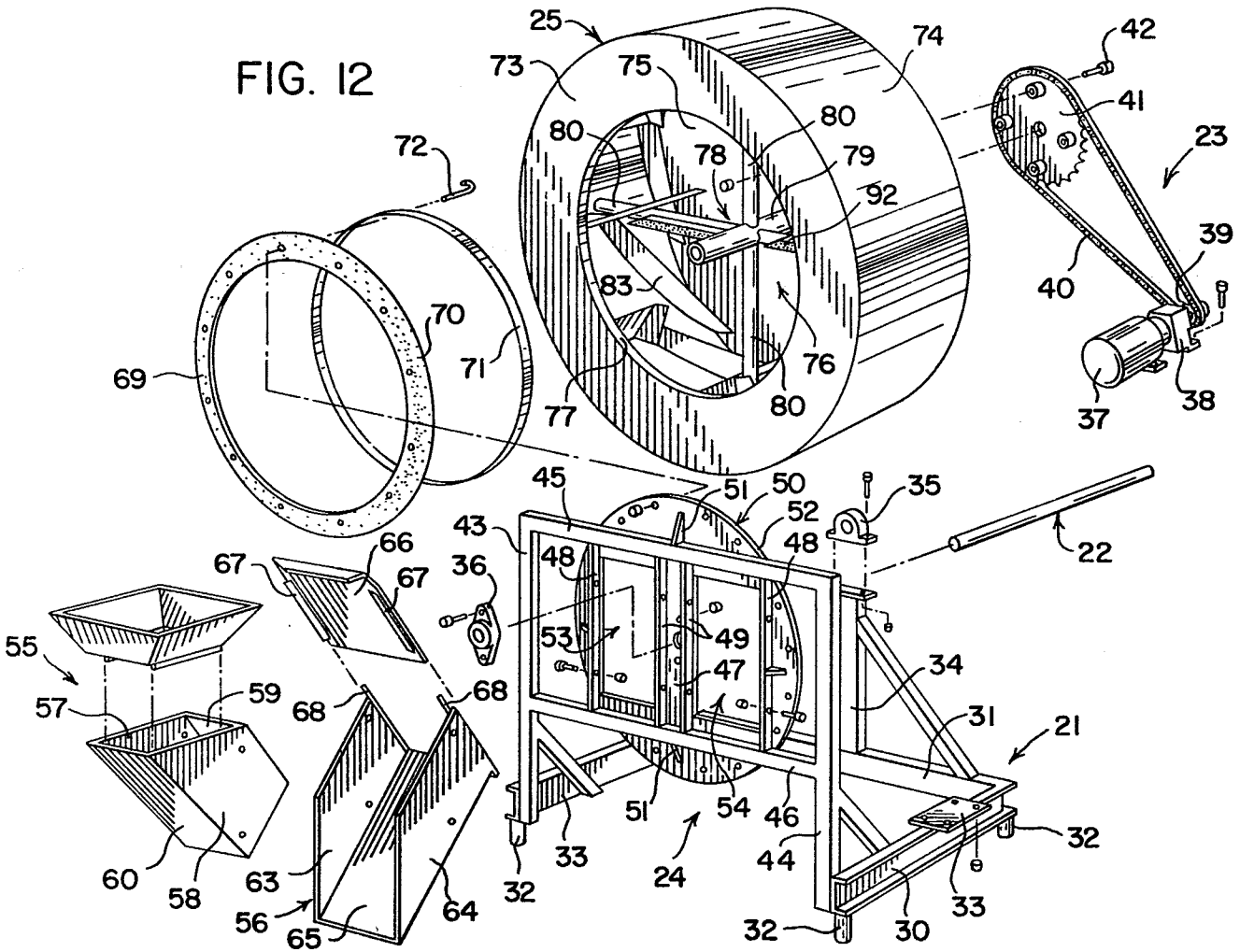

As shown (see FIG. 5), the closure plate 66 may have laterally directed flanges 67 resiliently engaging slide bars 68 secured adjacent the upward ends of the side walls, 63 and 64.

The drum service plate 50 carries a replaceable annular perimeter gasket 69. The gasket 69 has an annular body portion and sealing lip 70. The gasket is removably fastened on the plate perimeter 52 by a fastening ring 71 and a series of J-bolts 72.

The mixing drum 25

A mixing drum 25 is fabricated as a weldment having a front wall 73 connected by a cylindrical side wall 74 to a rear wall 75. As shown, the diameter of a drum 25 is twice the length of the side wall 74. A 2:1 ratio of height to width.

The front wall 73 of the drum 25 has a cylindrical supply-discharge opening 76 formed by an annular ring 77. The drum ring 77 is in sealing engagement with the frame grate gasket lip 70 to provide a mechanical dust seal during rotation of the drum 25.

The interior of the drum 25 has a spider structure 78. The spider structure 78 has an axial hub sleeve 79 for positioning around the drum shaft 22. The hub sleeve 79 is secured and positioned within the drum 25 by four equally spaced arms 80 extending radially to the side wall 74.

The outer end of the hub sleeve 79 projects coaxially into the drum opening 76. The inner end of the hub sleeve 79 is secured as at 81 to the rear drum wall 75. The medial portion of the hub sleeve 79 is precision machined to receive dust sealed bearings or a bushing 82 to provide for low-friction rotation of the drum 25 around the drum shaft 22.

As shown, a series of eight mixing blades 83 are equally spaced around the interior of the drum 25 and generally to the rear of or behind the spider radial arms 80. Each mixing blade 83 is a generally linear plate having an arcuate outer side 84 conforming to the contour of the side wall 74, an outer end 85 parallel to the plane of the end wall 75, a straight inner side 86, and an inner end 87 perpendicular to the inner side 86. Each blade 83 is secured within the drum 25, outer side 84 to side wall 74 and outer end 85 to end wall 75.

As shown, a series of eight conveying blades 88 are equally spaced around the interior of the drum 25 and generally to the front of or ahead of the spider radial arms 80. Each conveying blade 88 is a generally angulated plate having a corner joining an inner riser 89 and an outer paddle 90. A conveying riser 89 is secured to the inner end 87 of a mixing blade 83. A conveying paddle 90 is oriented generally parallel to the axis of the drum 25, is secured to the front wall 73 and side wall 74, and extends generally radially from the side wall 74 to adjacent the drum opening annular ring 77.

As shown, two opposed spider radial arms 80 carry forwardly directed rectangular flanges 91 mounting resilient blades 92 for wiping contact with the inner ends of the hopper chute 55 and scoop chute 56 during rotation of the drum 25. Upward movement of the wiper blades 92 tends to reduce compacting or "bridging" of mixed feed and clogging of the discharge stream through the scoop chute 56. Downward movement of the wiper blades 92, past the hopper chute 55, tends to distribute feed constituents radially toward the mixing blades 83.

As shown, the inner end of the spider hub sleeve 79 provides the axial component for a series of radial ribs 93. Four equally spaced rib elements 93 have inner ends connected to the hub sleeve 79. The outer end of each radial rib 93 is connected to the drum side wall 74. Together, the radial ribs 93 provide a structure for additional support of the hub sleeve 79 and for strengthening of the rear portion of the drum 25. The radial ribs 93 also provide the rear end connection for a series of axial bars 94. The medial portion of each of the four bars 94 is connected to a spider radial arm 80. The front end of each axial bar 94 is connected to the inner side of a mixing blade paddle 90 and to the drum front wall 73.

What is claimed is:

1. A mixing apparatus for livestock feed constituents having a portable base and a rotatable cylindrical drum with internal mixing and conveying blades, said drum being mounted on a shaft positioned above said base and projecting coaxially through a cylindrical opening in a front wall of said drum, said base carrying a pedestal structure extending upwardly adjacent a rear wall of said drum for mounting a rear end of said drum shaft:

said base also carrying a frame grate extending upwardly adjacent said drum front wall and having a vertically extending medial plate for mounting a front end of said drum shaft;

said front frame grate also having two openings formed therein, one on either side of said medial plate, one said opening being for supply of feed constituents, the other said opening being for discharge of mixed feed;

said front frame grate also providing a suspension mounting for a circular drum service plate, said service plate hanging free around the perimeter, being positioned coaxially around said drum shaft, and being oriented parallel with and adjacent to said drum cylindrical opening;

said drum service plate having two openings formed therein, one said opening being a supply opening in alignment with said frame grate supply opening, the other said opening being a discharge opening in alignment with said frame grate discharge opening;

said front frame grate also carrying a hopper chute extending downwardly through said aligned supply openings and said drum cylindrical opening and a closable scoop chute extending upwardly through said aligned discharge openings and said drum cylindrical opening.

2. A mixing apparatus according to claim 1, wherein: said base has parallel left side and right side channels; and said front frame grate has a lattice structure formed from four interconnected sections, left side and right side vertical sections having lower ends adapted to be secured to the front end of said base side channels, an upper lateral section cross-connecting the upper ends of said vertical sections, and a lower lateral section cross-connecting the medial portions of said vertical sections; the inner parameters of said interconnected sections defining an area oriented parallel with and adjacent to said drum front wall; said frame grate area being allocated to segments essential in use of said mixing apparatus, a medial segment for mounting said drum shaft, a side segment for feed constituent supply and an opposite side segment for mixed feed discharge.

3. A mixing apparatus according to claim 1, wherein: said hopper chute carried by said front frame grate has radially outer and inner vertical side walls, an upper baffle plate covering said side walls and extending downwardly from the upper edge of said service plate supply opening and a slide plate secured to the lower edges of said side walls and extending downwardly to the lower edge of said service plate supply opening; the downward end of said radially outer side wall carrying a triangular deflector plate directed toward the center of said drum.

4. A mixing apparatus according to claim 1, wherein, said drum has a 2:1 ratio of height to width.

5. A mixing apparatus according to claim 1, wherein: the interior of said drum has a spider structure with an axial hub sleeve for positioning around said drum shaft and equally spaced arms extending radially to the side wall of said drum; said mixing blades are a series of generally linear plates equally spaced around said drum interior and generally behind said spider radial arms; and said conveying blades are a series of generally angulated plates equally spaced around said drum interior and generally ahead of said spider radial arms.

6. A mixing apparatus according to claim 5, wherein, each said conveying blade angulated plate has a riser secured to one of said mixing blades and a paddle oriented generally parallel to the axis of said drum and extending generally radially from said drum side wall to adjacent said drum cylindrical opening.

7. A mixing apparatus according to claim 5, wherein, at least one of said spider radial arms carries a forwardly directed resilient blade for wiping contact with the inner end of said scoop chute carried by said front frame grate.

* * * * *

UNITED STATES PATENT AND TRADEMARK OFFICE

CERTIFICATE OF CORRECTION

PATENT NO. : 4,423,961

DATED : January 3, 1984

INVENTOR(S) : Roy I. Steiner

It is certified that error appears in the above-identified patent and that said Letters Patent are hereby corrected as shown below:

Col. 1, line 16, "3,839,066," should read -- 3,829,066,--;

Col. 2, line 1, "ojects" should read --objects--;

Signed and Sealed this

Ninth Day of April 1985

[SEAL]

*Attest:*

DONALD J. QUIGG

*Attesting Officer* *Acting Commissioner of Patents and Trademarks*